US011613442B2

(12) United States Patent
Isoda

(10) Patent No.: US 11,613,442 B2
(45) Date of Patent: Mar. 28, 2023

(54) SHEET DISCHARGE DEVICE, AND DOCUMENT CONVEYANCE DEVICE AND IMAGE FORMING APPARATUS THAT INCLUDE THE SAME

(71) Applicant: KYOCERA Document Solutions Inc., Osaka (JP)

(72) Inventor: Ren Isoda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/727,212

(22) Filed: Apr. 22, 2022

(65) Prior Publication Data

US 2022/0356033 A1 Nov. 10, 2022

(30) Foreign Application Priority Data

May 10, 2021 (JP) ..... JP2021-079502

(51) Int. Cl.
*B65H 31/08* (2006.01)
*G03G 15/00* (2006.01)

(52) U.S. Cl.
CPC ..... *B65H 31/08* (2013.01); *G03G 15/6529* (2013.01); *B65H 2404/7412* (2013.01)

(58) Field of Classification Search
CPC ..... B41J 29/13; B65H 31/02; B65H 29/22; B65H 2402/31; B65H 2402/54; G03G 21/1633
See application file for complete search history.

(56) References Cited

U.S. PATENT DOCUMENTS 7,463,860 B2 * 12/2008 Nobe ..... G03G 15/6552 399/25
7,547,015 B2 * 6/2009 Lee ..... B65H 31/20 271/224
8,424,871 B2 * 4/2013 Ino ..... G03G 15/602 271/223
8,430,399 B1 * 4/2013 Huang ..... B65H 1/04 271/223
9,010,754 B2 * 4/2015 Matsumoto ..... B65H 31/34 271/223
10,040,661 B2 * 8/2018 Yoshida ..... B65H 31/36
(Continued)

FOREIGN PATENT DOCUMENTS

JP 2009-267589 A 11/2009

*Primary Examiner* — Leslie A Nicholson, III
(74) *Attorney, Agent, or Firm* — Stein IP, LLC

(57) ABSTRACT

A sheet discharge device includes a sheet discharge portion, a sheet loading portion, and a stopper mechanism. The stopper mechanism includes a first stopper supported pivotably to a first retraction position and a first restriction position, a second stopper that is movable to a first position at which the second stopper is housed along a downstream end part of the sheet loading portion and a second position apart from the first position to a downstream side in a sheet discharge direction and is supported pivotably to a second retraction position and a second restriction position, and a link mechanism connecting the first stopper to the second stopper. When the second stopper is disposed at the first position, the first stopper is disposed at the first restriction position, and when the second stopper is disposed at the second position, the first stopper is disposed at the first retraction position.

10 Claims, 7 Drawing Sheets

(56) References Cited

U.S. PATENT DOCUMENTS

| | | | | |
|---|---|---|---|---|
| 11,130,649 | B2 * | 9/2021 | Okada | B65H 31/02 |
| 11,347,174 | B2 * | 5/2022 | Hanamoto | B65H 31/26 |
| 2021/0107301 | A1 * | 4/2021 | Takimoto | B41J 11/0045 |
| 2022/0274799 | A1 * | 9/2022 | Jo | B41J 29/02 |

* cited by examiner

SHEET DISCHARGE DEVICE, AND DOCUMENT CONVEYANCE DEVICE AND IMAGE FORMING APPARATUS THAT INCLUDE THE SAME

INCORPORATION BY REFERENCE

This application is based upon and claims the benefit of priority from the corresponding Japanese Patent Application No. 2021-79502 (filed on May 10, 2021), the entire contents of which are incorporated herein by reference.

BACKGROUND

The present disclosure relates to a sheet discharge device, and a document conveyance device and an image forming apparatus that include the same. The sheet discharge device discharges a sheet and is mounted in the image forming apparatus such as a copy machine or a printer, a sheet post-processing device that performs prescribed post-processing on a sheet that has been subjected to image formation processing, or the document conveyance device that automatically conveys a sheet document.

An image forming apparatus such as a copy machine or a laser printer includes a discharge tray for discharging thereon a sheet on which a desired image has been formed by an electrophotographic process or a document that has been conveyed by a document conveyance device to a document reading portion and thus has undergone reading of an image of the document therein. Typically, in order to allow a given amount of stacking, the discharge tray has an inclined surface that is formed between a discharge port and a loading portion thereof and has an upward gradient toward a discharge direction. A sheet or a document discharged through the discharge port slips down along the inclined surface and is stacked with a rear end thereof aligned.

In recent years, with an increase in speed of image formation processing, image forming apparatuses capable of high-speed sheet conveyance have been mainstream. When a sheet is conveyed at an increased speed to be discharged, upon being discharged, the sheet might go beyond a bent part between the inclined surface and the sheet loading portion into the sheet loading portion. This has led to a fear that a stacking failure might occur due to the sheet failing to slip down along the inclined surface.

SUMMARY

A sheet discharge device according to one aspect of the present disclosure includes a sheet discharge portion, a sheet loading portion, and a stopper mechanism. The sheet discharge portion discharges a sheet. The sheet loading portion is disposed on a downstream side of the sheet discharge portion with respect to a sheet discharge direction and has a sheet loading surface on which the sheet discharged from the sheet discharge portion is loaded. The stopper mechanism is provided in the sheet loading portion and aligns the sheet discharged from the sheet discharge portion by causing a distal end of the sheet to butt against itself. The stopper mechanism includes a first stopper, a second stopper, and a link mechanism. The first stopper is supported so as to be pivotable to a first retraction position at which the first stopper is folded down substantially horizontally along the sheet loading surface and to a first restriction position at which the first stopper is raised substantially perpendicularly with respect to the sheet loading surface. The second stopper is disposed on a downstream side of the first stopper with respect to the sheet discharge direction, is movable to a first position at which the second stopper is housed along a downstream end part of the sheet loading portion and to a second position to which the second stopper has moved from the first position to a downstream side in the sheet discharge direction, and is supported so as to be pivotable to a second retraction position at which the second stopper is retracted to a lower side relative to the sheet loading surface and to a second restriction position at which the second stopper protrudes to an upper side relative to the sheet loading surface. The link mechanism connects the first stopper to the second stopper. When the second stopper is disposed at the first position, the first stopper is disposed at the first restriction position, and when the second stopper is disposed at the second position, the first stopper is disposed at the first retraction position.

DETAILED DESCRIPTION

Figure 1:
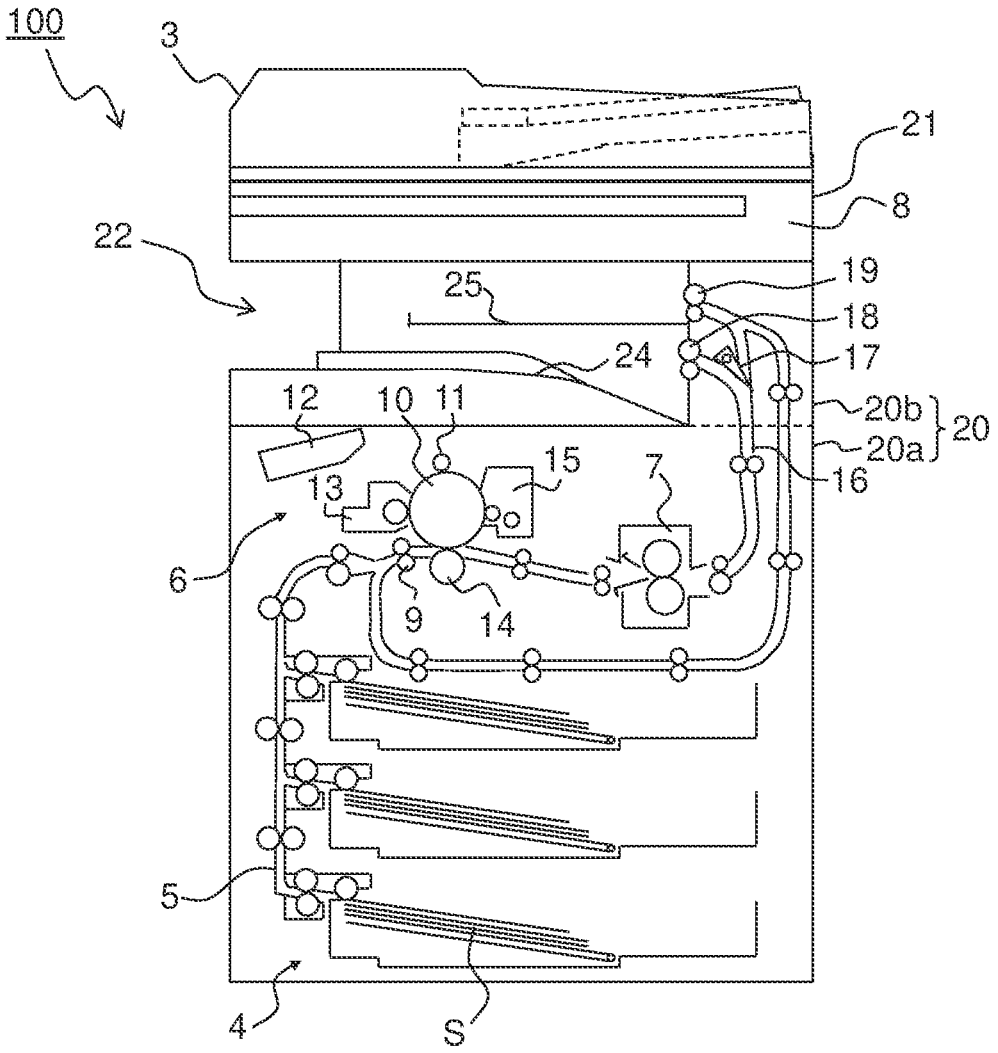
FIG. 1 is a schematic view showing an internal configuration of an image forming apparatus in which a document conveyance device including a sheet discharge device of the present disclosure is mounted.

With reference to the appended drawings, the following describes in detail an embodiment of the present disclosure. FIG. 1 is a schematic view showing an internal configuration of an image forming apparatus 100 in which a document conveyance device 3 including a sheet discharge device of the present disclosure is mounted. As shown in FIG. 1, the image forming apparatus 100 is a digital multi-functional peripheral of a so-called intra-body paper discharge type and is composed roughly of a main body housing 20 and an upper housing 21 arranged on top of the main body housing 20.

The main body housing 20 is composed of a lower housing 20*a* and a connection housing 20*b* that is positioned above the lower housing 20*a* along a right side part of the main body housing 20 in FIG. 1 and is connected to the upper housing 21. The lower housing 20*a* includes therein a paper feed portion 4 arranged in a lower part, a sheet conveyance path 5 arranged on a lateral upper side of the paper feed portion 4, an image forming portion 6 arranged above the paper feed portion 4, and a fixing portion 7 arranged on a downstream side (a right side in FIG. 1) of the image forming portion 6 in a sheet conveyance direction. In the connection housing 20*b*, there is provided a sheet discharge portion for discharging, from the main body housing 20, a sheet S that has been subjected to fixing and conveyed thereto. Furthermore, on a left side in the connection housing 20*b* immediately below the upper housing 21, there is formed an intra-body discharge space 22 that is largely open toward a left side surface and a front surface of the image forming apparatus 100.

The image forming portion 6 forms a prescribed toner image on the sheet S by an electrophotographic process. The image forming portion 6 includes, in addition to a photosensitive drum 10 that is a rotatably and axially supported image carrier, a charging device 11, an exposure device 12, a developing device 13, a transfer device 14, a cleaning device 15, and an unshown static elimination device, which are arranged around the photosensitive drum 10 along a rotation direction of the photosensitive drum 10.

An image reading portion 8 is provided in the upper housing 21. The image reading portion 8 reads image information on a document D (an example of a sheet). In order for a document to be read one by one, the document conveyance device 3 is opened, and the document is placed on a contact glass provided on an upper surface of the upper housing 21. Furthermore, in order for a bundle of documents to be read automatically, the bundle of documents is placed on a paper feed tray of the document conveyance device 3 in a closed state so that each of the bundle of documents is fed one by one automatically and sequentially onto the contact glass.

A description is given of a basic operation of the image forming apparatus 100 configured as above. First, a surface of the photosensitive drum 10 that rotates in a counterclockwise direction in FIG. 1 is uniformly charged by the charging device 11. Subsequently, based on image information read in the image reading portion 8, beam light from the exposure device 12 is applied to a circumferential surface of the photosensitive drum 10, and thus an electrostatic latent image is formed on the surface of the photosensitive drum 10. The electrostatic latent image is supplied with toner as a developer from the developing device 13 and thus is formed into a toner image.

Concurrently with the formation of the toner image, the sheet S is fed out from the paper feed portion 4 to the sheet conveyance path 5 and is stopped once from being conveyed at a registration roller pair 9. Further, at prescribed timing, the sheet S that has been stopped from being conveyed at the registration roller pair 9 is conveyed toward the photosensitive drum 10 on which the toner image has been formed, and on the photosensitive drum 10, the toner image on the surface thereof is transferred to the sheet S by the transfer device 14 formed of a transfer roller or the like. Further, the sheet S on which the toner image has been transferred is separated from the photosensitive drum 10 to be conveyed toward the fixing portion 7, and while passing through the fixing portion 7, the sheet S is subjected to heating and pressing processing, so that the toner image is fixed.

Upon completion of the processing of transferring the toner image to the sheet 5, residual toner remaining on the circumferential surface of the photosensitive drum 10 is removed by the cleaning device 15. After that, the photosensitive drum 10 is subjected to static elimination processing in which residual electric charge is eliminated by the static elimination device (not shown). Then, the circumferential surface is subjected again to charging processing by the charging device 11, and image formation is similarly performed thereafter.

The sheet S that has passed through the fixing portion 7 is conveyed directly into the connection housing 20*b* along a perpendicular conveyance path 16 directed perpendicularly upward. An upper part of the perpendicular conveyance path 16 is bifurcated leftward into two upper and lower conveyance paths in the connection housing 20*b*. The sheet S guided into the lower conveyance path by a switching guide 17 disposed in a bifurcation portion is discharged leftward from a first discharge roller pair 18 and stocked on a sheet discharge tray 24 formed on a bottom surface of the intra-body discharge space 22. The sheet S guided into the upper conveyance path by the switching guide 17, on the other hand, is discharged leftward from a second discharge roller pair 19 onto an auxiliary discharge tray 25.

Figure 2:
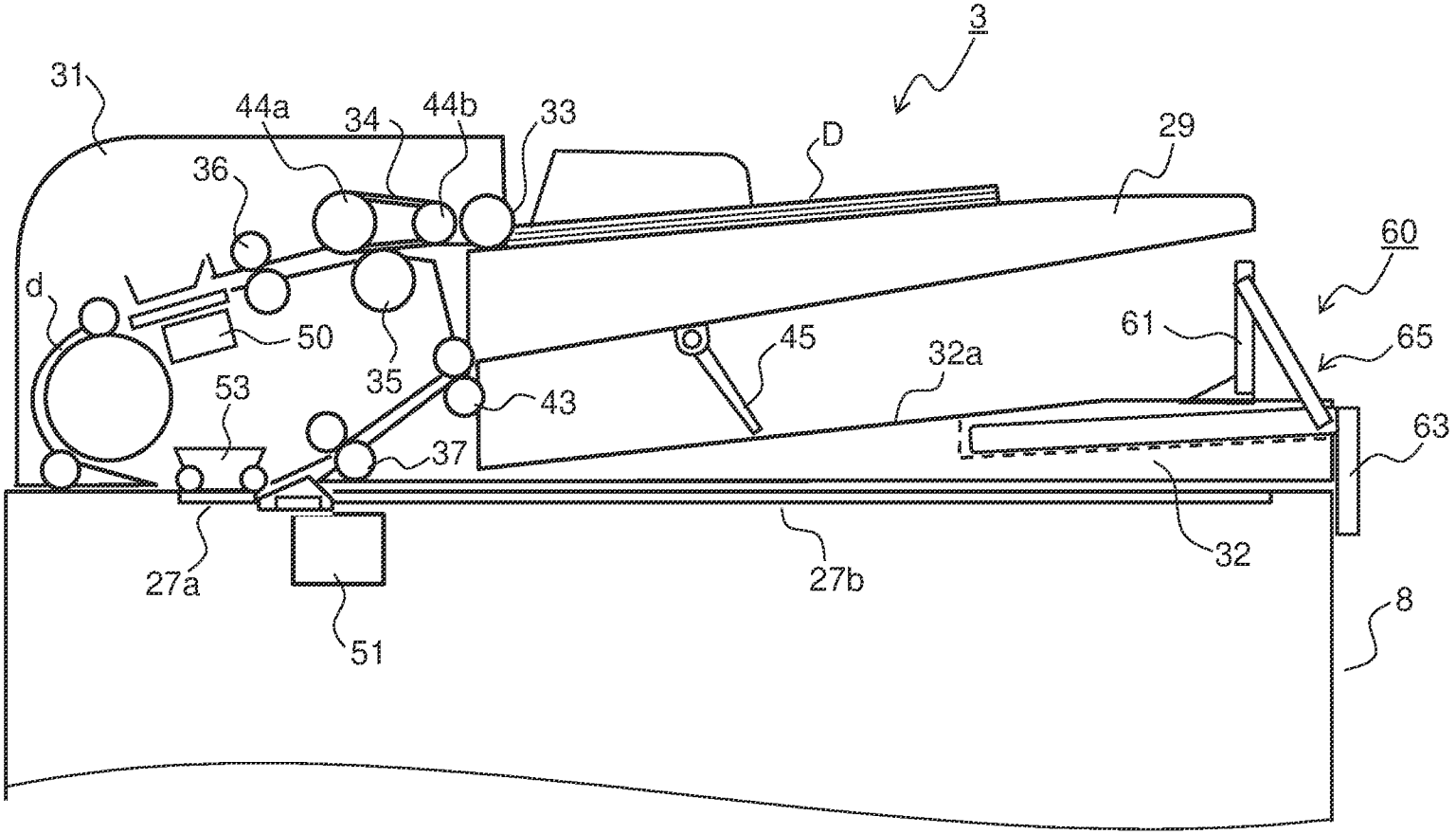
FIG. 2 is a side sectional view showing an internal structure of the document conveyance device.

FIG. 2 is a side sectional view showing an internal structure of the document conveyance device 3. The contact glass composed of an automatic reading glass 27*a* and a hand-placed document glass 27*b* is disposed on an upper surface of the image reading portion 8. The document conveyance device 3 is supported at a hinge (not shown) on a rear surface side (a far side relative to a plane on which FIG. 2 is drawn) of the image reading portion 8 so as to be operable and closable up and down with respect to the image reading portion 8.

In a cover member 31 of the document conveyance device 3, a document conveyance path d is formed to extend from a document feed tray 29 to a document discharge tray (sheet loading portion) 32. Along the document conveyance path d, there are provided a document conveyance member composed of a pick-up roller 33, a paper feed belt 34 with a separation roller 35, a registration roller pair 36, a conveyance roller pair 37, and so on, a discharge roller pair (sheet discharge portion) 43 that discharges the document D, and a back-side reading module 50 that reads an image on a back side of the document D.

The document conveyance path d is curved so as to be reversed in a part thereof extending between the registration roller pair 36 to the automatic reading glass 27*a*. Furthermore, along the document conveyance path d, a plurality of sheet detection sensors (not shown) including a paper feed sensor and a discharge sensor for detecting presence/absence or passing of the document D is provided at appropriate locations.

A front-side reading module 51 is disposed inside the image reading portion 8. The front-side reading module 51 reads an image of a document placed on the hand-placed document glass 27*b* while moving in a sub-scanning direction (a left-right direction in FIG. 2). Furthermore, in a state of being stopped from moving immediately below the auto reading glass 27*a*, the front-side reading module 51 reads an image on a front side of the document D being conveyed by the document conveyance device 3.

Next, a description is given of a document conveyance operation employing a sheet-through method using the document conveyance device 3. In the sheet-through method, a plurality of documents D is placed with image surfaces thereof oriented upward on the document feed tray 29. Typically, a plurality of upper ones of the documents D placed on the document feed tray 29 is fed by the pick-up roller 33 to a nip between the paper feed belt 34 and the separation roller 35. Further, only a topmost one of the plurality of upper ones of the documents D is separated by the separation roller 35 and is conveyed for a prescribed distance toward the registration roller pair 36. After that, the pick-up roller 33 and the paper feed belt 34 are stopped from being driven to rotate, thus ending primary paper feeding.

After a lapse of a prescribed amount of time since the end of the primary paper feeding, a secondary paper feed drive motor (not shown) operates to drive the registration roller pair 36 to rotate. By the registration roller pair 36, the document D is conveyed toward the automatic reading glass 27*a*. The document D conveyed to the automatic reading glass 27*a* comes in contact with a document pressing member 53 that is disposed to be opposed to the automatic reading glass 27*a* and thus is pressed thereby from above against the automatic reading glass 27*a*. Further, an image on the front side (a side toward the automatic reading glass 27*a*) of the document D is read by the front-side reading module 51 through the automatic reading glass 27*a*.

The document D that has passed through the automatic reading glass 27*a* is conveyed toward the conveyance roller pair 37 and the discharge roller pair 43 and then is finally discharged by the discharge roller pair 43 onto the document discharge tray 32.

Furthermore, in a case of reading a double-sided document, an image on a back side of the document is read by the back-side reading module 50 provided on an upstream side of the automatic reading glass 27*a*, and then an image on a front side of the document is read by the front-side reading module 51.

A document hold-down member 45 is supported to a lower surface of the document feed tray 29 so as to be swingable along a document discharge direction. The document hold-down member 45 holds down the document D discharged by the discharge roller pair 43 onto the document discharge tray 32 so as to prevent curling and lifting up of the document D.

On the document discharge tray 32, there is disposed a stopper mechanism 60 for aligning the document D discharged by the discharge roller pair 43 by causing a distal end of the document D to butt against itself. The stopper mechanism 60 includes a first stopper 61, a second stopper 71, and a link mechanism 80. A detailed configuration of the stopper mechanism 60 will be described later.

Figure 3:
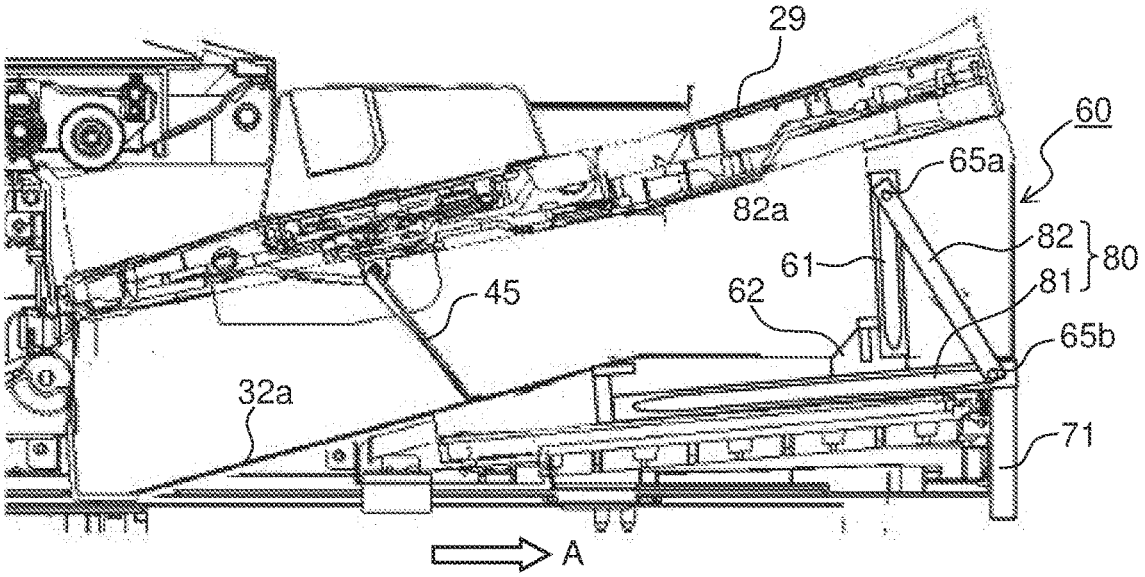
FIG. 3 is a partial side view of a vicinity of a document discharge tray of the document conveyance device shown in FIG. 2.
Figure 4:
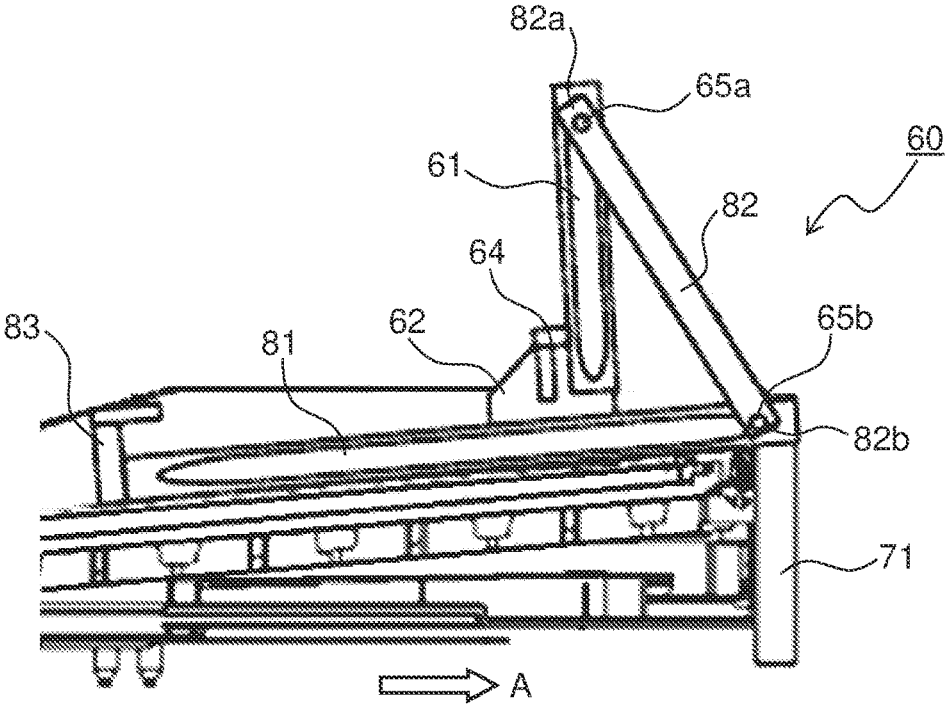
FIG. 4 is an enlarged view of a stopper mechanism shown in FIG. 3.
Figure 5:
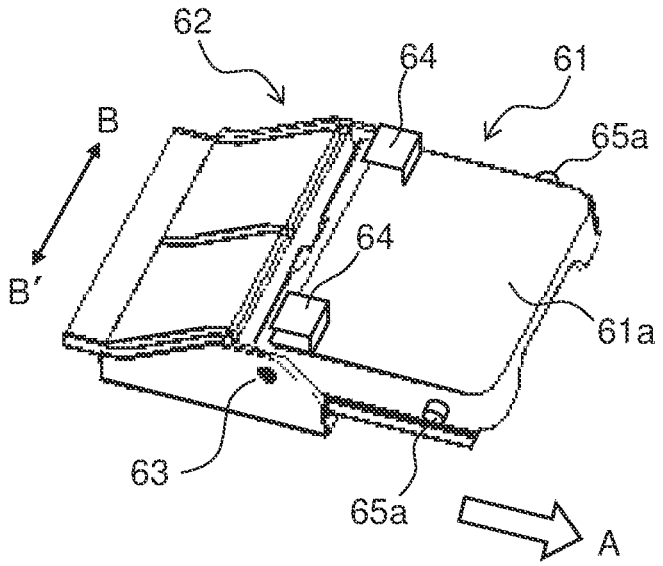
FIG. 5 is a perspective view of a first stopper in a state of being disposed at a retraction position.
Figure 6:
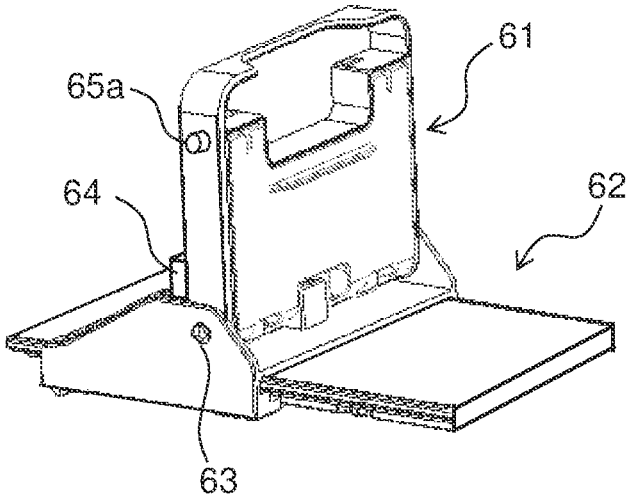
FIG. 6 is a perspective view of the first stopper in a state of being disposed at a restriction position.
Figure 7:
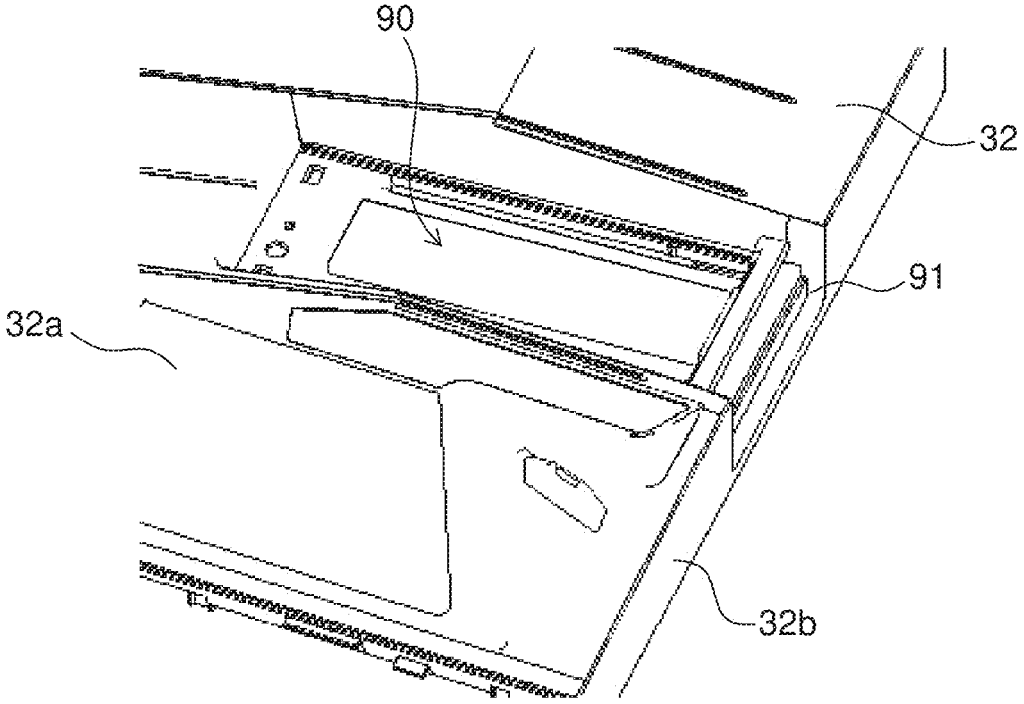
FIG. 7 is a partial perspective view of a vicinity of a stopper mounting portion on a document loading surface of the document discharge tray.

FIG. 3 is a partial side view of a vicinity of the document discharge tray 32 of the document conveyance device 3 shown in FIG. 2. FIG. 4 is an enlarged view of the stopper mechanism 60 shown in FIG. 3. FIG. 5 and FIG. 6 are perspective views of the first stopper 61. FIG. 7 is a partial perspective view of a vicinity of a stopper mounting portion 90 on a document loading surface 32*a* of the document discharge tray 32. With reference to FIG. 3 to FIG. 7, a description is given of a configuration of the stopper mechanism 60. The stopper mechanism 60 includes the first stopper 61, the second stopper 71, and the link mechanism 80.

The first stopper 61 is supported so as to be swingable along the document discharge direction about, as a swing support point, a first support shaft 63 provided in a base 62. The first stopper 61 is swingable between a retraction position (a first retraction position, see FIG. 5) at which the first stopper 61 is folded down along the document loading surface 32*a* (a sheet loading surface) and a restriction position (a first restriction position, see FIG. 6) at which the first stopper 61 is raised from the document loading surface 32*a* of the document discharge tray 32. When disposed at the retraction position, the first stopper 61 is housed on a lower side of the document loading surface 32*a*. The base 62 is mounted in a concave stopper mounting portion 90 that is formed in the document loading surface 32*a* of the document discharge tray 32 shown in FIG. 7.

An engaged portion 64 is formed on a restriction surface 61*a* that is an upstream-side surface of the first stopper 61 with respect to the document discharge direction (a direction of an arrow A). A pair of engaged portions 64 is formed on both sides of the restriction surface 61*a* in a width direction thereof (a direction of arrows B and B') on a side toward a proximal end part of the restriction surface 61*a* (in a neighborhood of the first support shaft 63). An engaging portion 83 of a first link member 81 engages with the engaged portions 64. A pair of first support point bosses 65*a* is formed at both side end parts of the first stopper 61 in a width direction thereof so as to protrude outward in the width direction.

Figure 8:
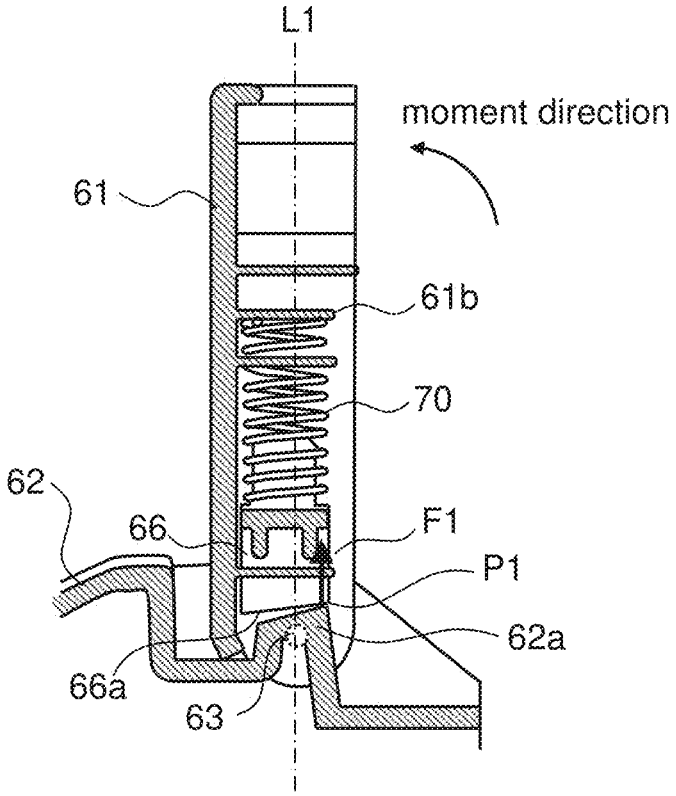
FIG. 8 is a side sectional view of the first stopper in a state of being disposed at the restriction position.
Figure 9:
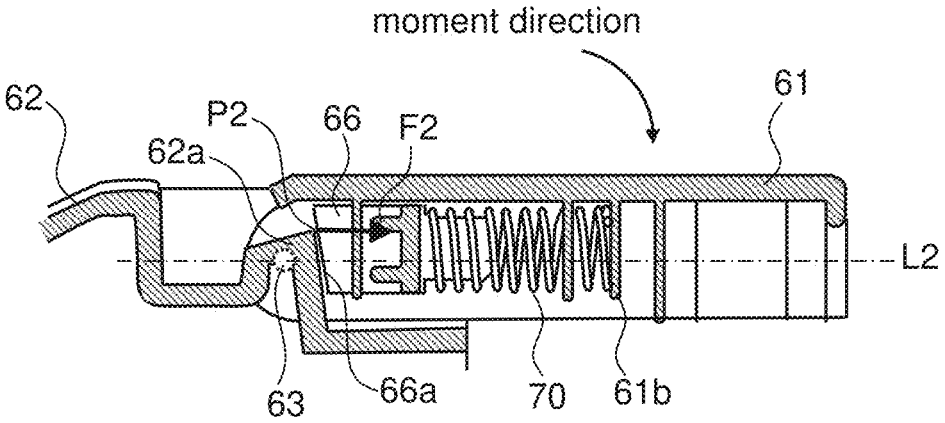
FIG. 9 is a side sectional view of the first stopper in a state of being disposed at the retraction position.

FIG. 8 and FIG. 9 are side sectional views of the first stopper 61 in a state of being disposed at the restriction position and a state of being disposed at the retraction position, respectively. A coil spring 70 is disposed inside the first stopper 61. The coil spring 70 extends in a direction orthogonal to the first support shaft 63, and one end part (on a side distant from the first support shaft 63, an upper end part in FIG. 8) of the coil spring 70 is secured to a spring receiving portion 61*b*. The other end part (on a side near the first support shaft 63, a lower end part in FIG. 8) of the coil spring 70 is a free end to which a pressing member 66 is attached. The pressing member 66 is biased in such a direction as to approach the first support shaft 63 under a biasing force of the coil spring 70. In the base 62, there is formed a pressed portion 62*a* with which the pressing member 66 is brought into pressure contact. The coil spring 70, the pressing member 66, and the pressed portion 62*a* constitute a first biasing mechanism that applies a pivotal load to the first stopper 61.

As shown in FIG. 8, a pressing surface 66*a* of the pressing member 66 is inclined as viewed from an axis direction of the first support shaft 63. To be more specific, in a state where the first stopper 61 is disposed at the restriction position, the pressing surface 66*a* is inclined upward toward a moving direction (a rightward direction in FIG. 8) to the retraction position. An upper surface of the pressed portion 62*a* of the base 62 is inclined to a larger degree with respect to a horizontal plane than the pressing surface 66*a* is, and the pressed portion 62*a* and the pressing surface 66*a* are in point contact with each other at a contact point P1 as viewed from the axis direction. With respect to a perpendicular line L1 passing through the first support shaft 63, the contact point P1 is positioned on a downstream side (a right side in FIG. 8) in the moving direction of the first stopper 61 from the restriction position to the retraction position.

With this configuration, at the contact point P1, a reaction force F1 acting on the pressing surface 66*a* from the pressed portion 62*a* generates a moment in a counterclockwise direction about the first support shaft 63 and thus biases the first stopper 61 in a direction (a counterclockwise direction in FIG. 8) toward the restriction position. As a result, the first stopper 61 disposed at the restriction position is prevented from easily moving to the retraction position, and thus it is possible to suppress occurrence of a defect that the first stopper 61 might move to the retraction position due to, for example, a shock caused when a document discharged to the document discharge tray 32 is taken out.

On the other hand, in a case where the first stopper 61 is disposed at the retraction position, as shown in FIG. 9, a side surface of the pressed portion 62*a* of the base 62 is inclined to a larger degree with respect to the horizontal plane than the pressing surface 66*a* is, and the pressed portion 62*a* and the pressing surface 66*a* are in point contact with each other at a contact point P2 as viewed from the axis direction. With respect to a horizontal line L2 passing through the first support shaft 63, the contact point P2 is positioned on an upstream side (an upper side in FIG. 9) in the moving direction of the first stopper 61 from the restriction position to the retraction position.

With this configuration, at the contact point P2, a reaction force F2 acting on the pressing surface 66*a* from the pressed portion 62*a* generates a moment in a clockwise direction about the first support shaft 63 and thus biases the first stopper 61 in a direction (a clockwise direction in FIG. 9) toward the retraction position. As a result, the first stopper 61 disposed at the retraction position is prevented from easily moving to the restriction position, and thus it is possible to suppress occurrence of a defect that the first stopper 61 disposed at the retraction position might move to the restriction position when the document conveyance device 3 is opened and closed with respect to the image reading portion 8 so that a hand-placed document is read.

Referring back to FIG. 3 and FIG. 4, the second stopper 71 is supported to an end part of the first link member 81 on a downstream side (a right side in FIG. 4) in the document discharge direction. The second stopper 71 is movable to a first position (see FIG. 3) at which the second stopper 71 is housed along an end edge 32*b* (see FIG. 7) of the document discharge tray 32 on the downstream side in the document discharge direction and to a second position (see FIG. 10) apart from the end edge 32*b* of the document discharge tray 32 to the downstream side in the document discharge direction (to which the second stopper 71 has moved from the first position to the downstream side in the document discharge direction).

The link mechanism 80 includes the first link member 81 and a second link member 82. The first link member 81 is disposed between the base 62 and the stopper mounting portion 90 and is supported so as to be reciprocatable parallel to the document discharge direction. At a downstream part of the first link member 81 in the document discharge direction, a pair of second support point bosses 65*b* is formed to protrude outward in the width direction. At an end part of the first link member 81 on the downstream side (a right side in FIG. 3) in the document discharge direction, the second stopper 71 is supported so as to be pivotable in an up-down direction. At an end part of the first link member 81 on an upstream side (a left side in FIG. 3) in the document discharge direction, there is formed the engaging portion 83 that has an L-shape in a side view and engages with the engaged portions 64 of the first stopper 61.

A pair of second link members 82 is disposed on both sides of the base 62 in the width direction. A first end part (upper end part) 82*a* of each of the second link members 82 on an upstream side with respect to the document discharge direction is pivotably connected to a corresponding one of the first support point bosses 65*a* formed on the first stopper 61. A second end part (lower end part) 82*b* of each of the second link members 82 on a downstream side is pivotably connected to a corresponding one of the second support point bosses 65*b* formed at an end part of the first link member 81 on the downstream side in the document discharge direction.

Next, a description is given of a method for adjusting respective positions of the first stopper 61 and the second stopper 63 of the stopper mechanism 60 so as to correspond to a size of the document D discharged to the document discharge tray 32. In a case where a small-sized (A4-sized or smaller) document D is discharged, a pivot end of the first stopper 61 is grasped and operated so that the first stopper 61 pivots from the retraction position (see FIG. 5) to the restriction position (see FIG. 6). As shown in FIG. 3, at the restriction position at which the first stopper 61 is raised from the document loading surface 32*a*, the first stopper 61 aligns the small-sized (for example, an A4-sized) document D by causing a distal end of the document D to butt against itself.

Furthermore, as the first stopper 61 pivots from the retraction position to the restriction position, the first end part 82*a* of each of the second link members 82 is lifted upward, and the second end part 82*b* moves to the upstream side in the document discharge direction. As a result, the first link member 81 connected to the second end part 82*b* of each of the second link members 82 also moves to the upstream side in the document discharge direction. Thus, the second stopper 71 is housed in a stopper housing portion 91 (see FIG. 7) formed at the end edge 32*b* of the document discharge tray 32 on the downstream side in the document discharge direction.

Figure 10:
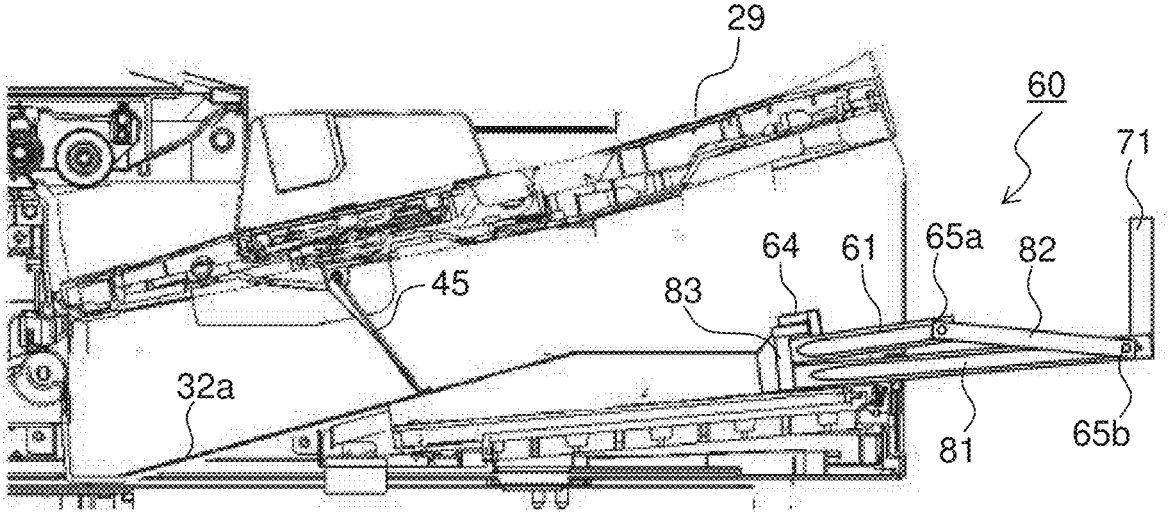
FIG. 10 is a partial side view of a vicinity of the document discharge tray of the document conveyance device shown in FIG. 2, illustrating how the stopper mechanism is disposed in a case where a large-sized document is discharged.

FIG. 10 is a partial side view of a vicinity of the document discharge tray 32 of the document conveyance device 3 shown in FIG. 2, illustrating how the stopper mechanism 60 is disposed in a case where a large-sized document is discharged. In a case where a large-sized (A3-sized) document D is discharged, the second stopper 71 housed in the stopper housing portion 91 is pulled out from a state shown in FIG. 3 to the downstream side in the document discharge direction (to a right side in FIG. 3).

As the second stopper 71 is pulled out, the first link member 81 to which the second stopper 71 is connected also moves to the downstream side in the document discharge direction. As a result, the second end part 82*b* of each of the second link members 82 connected to the first link member 81 also moves to the downstream side in the document discharge direction, and thus the first end part 82*a* of each of the second link members 82 is pulled down. Thus, as shown in FIG. 10, the first stopper 61 connected to the first end part 82*a* of each of the second link members 82 pivots from the restriction position to the retraction position against a biasing force of the coil spring 70.

Furthermore, as the first link member 81 moves to the downstream side in the document discharge direction, the engaging portion 83 of the first link member 81 engages with the engaged portions 64 of the first stopper 61. Thus, the first stopper 61 is retained at the retraction position.

Moreover, a pivot end of the second stopper 71 pivotably connected to the first link member 81 is grasped and operated so that the second stopper 71 pivots upward, and thus the second stopper 71 is retained in a state of being raised substantially perpendicularly with respect to the first member 81. As shown in FIG. 10, at a restriction position at which the second stopper 71 protrudes to an upper side relative to the document loading surface 32*a* of the document discharge tray 32, the second stopper 71 aligns the large-sized (A3-sized) document D by causing a distal end of the document D to butt against itself.

Figure 11:
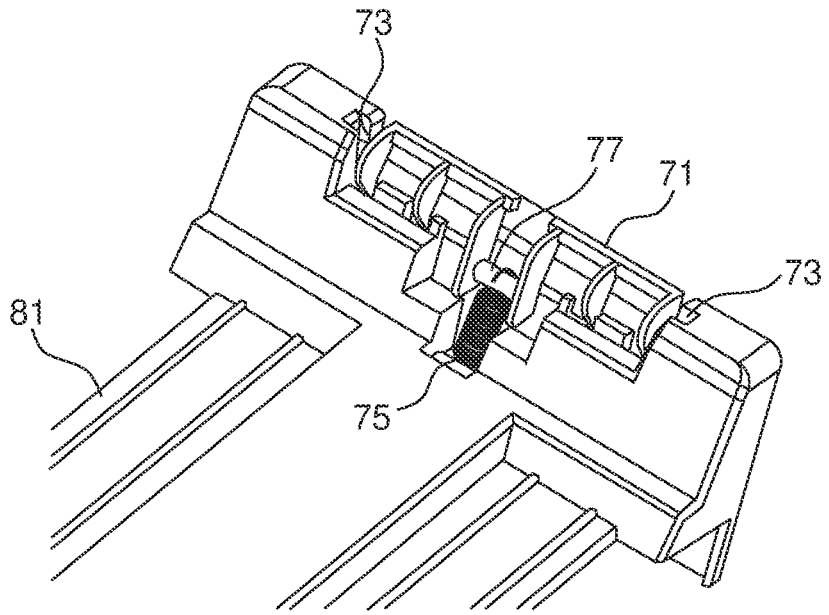
FIG. 11 is a perspective view of a connection part between a second stopper and a first link member, illustrating a state where the second stopper is disposed at a retraction position.
Figure 12:
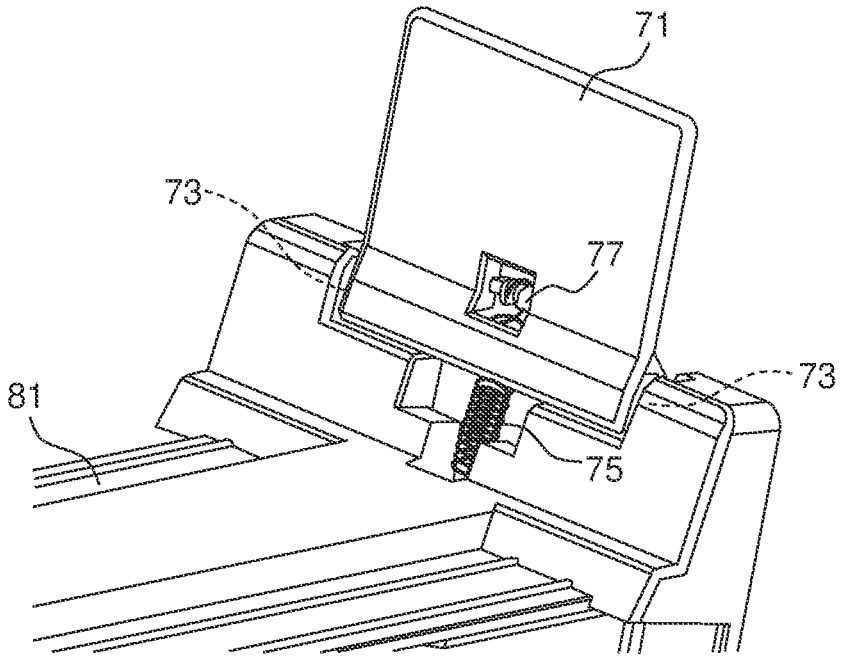
FIG. 12 is a perspective view of the connection part between the second stopper and the first link member, illustrating a state where the second stopper is disposed at a restriction position.

FIG. 11 and FIG. 12 are perspective views of a connection part between the second stopper 71 and the first link member 81. FIG. 11 is a view showing a state where the second stopper 71 is disposed at a retraction position (a second retraction position) at which the second stopper 71 is retracted to a lower side relative to the document loading surface 32*a*. FIG. 12 is a view showing a state where the second stopper 71 is disposed at the restriction position (a second restriction position) at which the second stopper 71 protrudes to an upper side relative to the document loading surface 32*a*.

The second stopper 71 includes a second support shaft 73 protruding from each of both end edges thereof in the width direction, and the second support shaft 73 is rotatably supported to the first link member 81. A tension spring 75 is connected between the first link member 81 and the second stopper 71. One end part of the tension spring 75 is secured to a spring securing portion (not shown) of the first link member 81, and the other end part thereof engages with a spring mounting portion 77 of the second stopper 71. The tension spring 75 and the spring mounting portion 77 constitute a second biasing mechanism that applies a pivotal load to the second stopper 71.

As shown in FIG. 11, when the second stopper 71 is disposed at the retraction position, the spring mounting portion 77 is positioned on a lower side (on a downstream side in a moving direction of the second stopper 71 from the restriction position to the retraction position) relative to the second support shaft 73. With this configuration, a biasing force of the tension spring 75 generates a moment in a clockwise direction in FIG. 10 about the second support shaft 73 and thus biases the second stopper 71 in a direction toward the retraction position. As a result, the second stopper 71 disposed at the retraction position is prevented from easily moving to the restriction position, and thus it is possible to suppress occurrence of a defect that the second stopper 71 disposed at the retraction position might move to the restriction position when the document conveyance device 3 is opened and closed with respect to the image reading portion 8 so that a hand-placed document is read.

When a prescribed force is applied to the second stopper 71 so that the second stopper 71 pivots from a state shown in FIG. 11 toward the restriction position, the spring mounting portion 77 is moved away from the spring securing portion and thus pulls the tension spring 75 so that the second stopper 71 is disposed at the restriction position as shown in FIG. 12. When the second stopper 71 is disposed at the restriction position, the spring mounting portion 77 is positioned on an upper side (on a downstream side in a moving direction of the second stopper 71 from the retraction position to the restriction position) relative to the second support shaft 73.

With this configuration, the biasing force of the tension spring 75 generates a moment in a counterclockwise direction in FIG. 10 about the second support shaft 73 and thus biases the second stopper 71 in a direction toward the restriction position. As a result, the second stopper 71 disposed at the restriction position is prevented from easily moving to the retraction position, and thus it is possible to suppress occurrence of a defect that the second stopper 71 might move to the retraction position due to, for example, a shock caused when a document discharged to the document discharge tray 32 is taken out. When a prescribed force is applied to the second stopper 71 so that the second stopper 71 pivots from a state shown in FIG. 12 toward the retraction position, a return is made to the state shown in FIG. 11 in which the second stopper 71 is retained at the retraction position under resilience of the tension spring 75.

In a case where a small-sized document D is discharged from a state shown in FIG. 10, the second stopper 71 is caused to pivot to the retraction position and then is moved to the upstream side (a left side in FIG. 10) in the document discharge direction to be housed in the stopper housing portion 91. Furthermore, as the second stopper 71 moves, the engaging portion 83 also moves to the upstream side in the document discharge direction and thus is disengaged from the engaged portions 64 of the first stopper 61. Moreover, the second end part 82*b* of each of the second link members 82 also moves to the upstream side in the document discharge direction, and thus the first end part 82*a* of each of the second link member 82 is lifted. Thus, the first stopper 61 connected to the first end part 82*a* of each of the second link members 82 pivots from the retraction position to the restriction position against the biasing force of the coil spring 70.

According to the configuration of this embodiment, as the second stopper 71 moves from the first position to the second position, the first stopper 61 pivots from the restriction position to the retraction position, and as the second stopper 71 moves from the second position to the first position, the first stopper 61 pivots from the retraction position to the restriction position. That is, a single operation allows both of the first stopper 61 and the second stopper 71 to be changed in how they are disposed. Accordingly, there is no need for the first stopper 61 and the second stopper 71 to be individually changed in how they are disposed, and thus operability of the stopper mechanism 60 is improved.

Furthermore, when the second stopper 71 is moved to the second position, the engaging portion 83 of the first link member 81 engages with the engaged portions 64 of the first stopper 61 so that the first stopper 61 is retained at the retraction position, and thus the first stopper 61 disposed at the retraction position is prevented from easily moving to the restriction position. Accordingly, it is possible to securely prevent occurrence of the defect that the first stopper 61 disposed at the retraction position might move to the restriction position when the document conveyance device 3 is opened and closed with respect to the image reading portion 8 so that a hand-placed document is read.

Furthermore, when the first stopper 61 and the second stopper 71 are disposed at their restriction positions, respectively, the first stopper 61 and the second stopper 71 are biased in directions toward the restriction positions by the coil spring 70 and the tension spring 75, respectively. Furthermore, when the first stopper 61 and the second stopper 71 are disposed at their retraction positions, respectively, the first stopper 61 and the second stopper 71 are biased in directions toward the retraction positions by the coil spring 70 and the tension spring 75, respectively. Accordingly, there is no fear that the first stopper 61 and the second stopper 71 might move accidentally due to vibrations or a shock, and thus usability of the first stopper 61 and the second stopper 71 can be improved.

Other than the above, the present disclosure is not limited to the foregoing embodiment and can be variously modified without departing from the spirit of the present disclosure. For example, while the foregoing embodiment describes, as an example, the document conveyance device 3 including a sheet discharge device including the discharge roller pair 43 that discharges a document and the document discharge tray 32 on which a discharged document is loaded and the document conveyance member including the pick-up roller 33, the paper feed belt 34 with the separation roller 35, the registration roller pair 36, the conveyance roller pair 37, and so on, the present disclosure is also applicable exactly in a similar manner to a sheet discharge device mounted in the image forming apparatus 100 including the first discharge roller pair 18 and the sheet discharge tray 24 on which a sheet discharged from the first discharge roller pair 18 is loaded or a sheet discharge device mounted in a sheet post-processing device that performs, with respect to a sheet on which an image has been formed, post-processing such as punch hole formation, a stapling process, and a sorting process.

The present disclosure is usable in a sheet discharge device including a sheet loading portion on which a discharged sheet is loaded and a stopper that aligns a sheet discharged to the sheet loading portion by causing a distal end of the sheet to butt against itself. Through the use of the present disclosure, it is possible to provide a sheet discharge device that uses a simple configuration to dispose a stopper at positions corresponding respectively to sheets of a plurality of different sizes and is capable of restricting undesired movement of the stopper.

What is claimed is:

1. A sheet discharge device, comprising:

a sheet discharge portion that discharges a sheet;

a sheet loading portion that is disposed on a downstream side of the sheet discharge portion with respect to a sheet discharge direction and has a sheet loading surface on which the sheet discharged from the sheet discharge portion is loaded; and a stopper mechanism that is provided in the sheet loading portion and aligns the sheet discharged from the sheet discharge portion by causing a distal end of the sheet to butt against itself, wherein the stopper mechanism includes:

a first stopper that is supported so as to be pivotable to a first retraction position at which the first stopper is folded down along the sheet loading surface and to a first restriction position at which the first stopper is raised with respect to the sheet loading surface;

a second stopper that is disposed on a downstream side of the first stopper with respect to the sheet discharge direction, is movable to a first position at which the second stopper is housed along an end part of the sheet loading portion on the downstream side and to a second position to which the second stopper has moved from the first position to a downstream side in the sheet discharge direction, and is supported so as to be pivotable to a second retraction position at which the second stopper is retracted to a lower side relative to the sheet loading surface and to a second restriction position at which the second stopper protrudes to an upper side relative to the sheet loading surface; and a link mechanism that connects the first stopper to the second stopper, and when the second stopper is disposed at the first position, the first stopper is disposed at the first restriction position, and when the second stopper is disposed at the second position, the first stopper is disposed at the first retraction position.

2. The sheet discharge device according to claim 1, wherein the link mechanism includes:

a first link member that is supported to the sheet loading portion so as to be reciprocatable parallel to the sheet discharge direction and has an end part on the downstream side in the sheet discharge direction to which the second stopper is connected; and a second link member that has a first end part on an upstream side and a second end part on a downstream side with respect to the sheet discharge direction, the first end part being pivotably connected to the first stopper, the second end part being pivotably connected to the first link member, when the second stopper is moved from the first position to the second position, the first link member moves to the downstream side in the sheet discharge direction, and as the first link member moves, the first end part of the second link member pulls down the first stopper so that the first stopper moves from the first restriction position to the first retraction position, and when the second stopper is moved from the second position to the first position, the first link member moves to an upstream side in the sheet discharge direction, and as the first link member moves, the first end part of the second link member lifts up the first stopper so that the first stopper moves from the first retraction position to the first restriction position.

3. The sheet discharge device according to claim 2, wherein the first link member includes an engaging portion that, when the second stopper is moved to the second position, engages with an engaged portion of the first stopper so that the first stopper is retained at the first retraction position.

4. The sheet discharge device according to claim 1, further comprising:

a first biasing mechanism that applies a pivotal load to the first stopper, wherein the first biasing mechanism biases the first stopper as disposed at the first retraction position in a direction from the first restriction position toward the first retraction position and biases the first stopper as disposed at the first restriction position in a direction from the first retraction position toward the first restriction position.

5. The sheet discharge device according to claim 4, wherein the first stopper is supported so as to be swingable along the sheet discharge direction about a first support shaft as a swing support point provided in a base, the first biasing mechanism includes:

a coil spring that is disposed inside the first stopper and extends in a direction orthogonal to the first support shaft;

a pressing member that is attached to an end part of the coil spring on a side near the first support shaft and is biased in such a direction as to approach the first support shaft under a biasing force of the coil spring; and a pressed portion that is formed in the base and is in point contact with a pressing surface of the pressing member as viewed from an axis direction of the first support shaft, in a state where the first stopper is disposed at the first restriction position, a contact point between the pressed portion and the pressing surface is positioned on a downstream side in a moving direction of the first stopper from the first restriction position to the first retraction position with respect to a perpendicular line passing through the first support shaft, and in a state where the first stopper is disposed at the first retraction position, the contact point between the pressed portion and the pressing surface is positioned on an upstream side in the moving direction of the first stopper from the first restriction position to the first retraction position with respect to a horizontal line passing through the first support shaft.

6. The sheet discharge device according to claim 1, wherein when disposed at the first retraction position, the first stopper is housed on a lower side relative to the sheet loading surface.

7. The sheet discharge device according to claim 1, further comprising:

a second biasing mechanism that applies a pivotal load to the second stopper, wherein the second biasing mechanism biases the second stopper as disposed at the second retraction position in a direction from the second restriction position toward the second retraction position and biases the second stopper as disposed at the second restriction position in a direction from the second retraction position toward the second restriction position.

8. The sheet discharge device according to claim 7, wherein the link mechanism includes:

a first link member that is supported to the sheet loading portion so as to be reciprocatable parallel to the sheet discharge direction and has an end part on the downstream side in the sheet discharge direction to which the second stopper is connected; and a second link member that has a first end part on an upstream side and a second end part on a downstream side with respect to the sheet discharge direction, the first end part being pivotably connected to the first stopper, the second end part being pivotably connected to the first link member, the second stopper is supported to the first link member so as to be rotatable about a second support shaft as a swing support point, the second biasing mechanism includes:

a tension spring that is connected between the first link member and the second stopper; and a spring mounting portion that is formed in the second stopper and with which the tension spring engages, when the second stopper is disposed at the second retraction position, the spring mounting portion is positioned on a downstream side in a moving direction of the second stopper from the second restriction position to the second retraction position relative to the second support shaft, and when the second stopper is disposed at the second restriction position, the spring mounting portion is positioned on a downstream side in a moving direction of the second stopper from the second retraction position to the second restriction position relative to the second support shaft.

9. A document conveyance device, comprising:

the sheet discharge device according to claim 1; and a document conveyance member that conveys a sheet-shaped document to the sheet discharge device.

10. An image forming apparatus, comprising:

an image forming portion that forms an image on a sheet-shaped recording medium, and the sheet discharge device according to claim 1 that discharges the recording medium on which the image has been formed by the image forming portion.

* * * * *